US006344769B1

(12) United States Patent
Giuroiu

(10) Patent No.: US 6,344,769 B1
(45) Date of Patent: Feb. 5, 2002

(54) PRECISION DIFFERENTIAL SWITCHED CURRENT SOURCE

(75) Inventor: Horia Giuroiu, Campbell, CA (US)

(73) Assignee: Oki Semiconductor, Sunnyvale, CA (US)

( * ) Notice: Subject to any disclaimer, the term of this patent is extended or adjusted under 35 U.S.C. 154(b) by 0 days.

(21) Appl. No.: 09/689,810

(22) Filed: Oct. 13, 2000

(51) Int. Cl.[7] ..... G05F 1/10

(52) U.S. Cl. ..... 327/538; 327/541; 323/315

(58) Field of Search ..... 327/530, 538–543; 323/312–317; 330/288

(56) References Cited

U.S. PATENT DOCUMENTS 6,271,716 B1 * 8/2001 Nayebi et al. ..... 327/538

OTHER PUBLICATIONS

Baird et al, Rex T., "A Low Oversampling Ratio 14–b 500–kHz AE ADC with a Self–Calibrated Multibit DAC", pp. 312–320, IEEE Journal Of Solid–State Circuits, vol. 31, No. 3, Mar. 1996.

Miki et al, Takahiro, "An 80–MHz 8–bit CMOS D/A Converter", pp. 983–988, IEEE Journal of Solid–State Cirucits, vol. SC–21, No. 6, Dec. 1986.

* cited by examiner

*Primary Examiner*—Kenneth B. Wells
(74) *Attorney, Agent, or Firm*—Volentine Francos, PLLC

(57) ABSTRACT

A switched current source is provided for differentially switching high currents onto different loads at high speed and with a high degree of accuracy. The switched current source includes a differential amplifier, which receives an input current and selectively provides first and second output currents, a voltage amplifier, and a capacitor, which compensates the frequency response of certain feedback amplifiers and stores the potential of a certain node during transients. The differential amplifier includes two transistors each connected to the input current and for providing one of the output currents when activated. The first and second transistors are controlled by first through fourth switches. The first switch and the second switches turn on the first and second transistors, respectively, when closed. The third and the fourth switches pull down the first and second transistors, respectively, when closed. By pulling down the first and second transistors, the circuit increases operation speed and accuracy by preventing them from floating. The first and third switches are always in opposite positions, as are the second and fourth switches, i.e., when the first switch is open, the third switch is closed and vice versa. The current input may come from a current mirror connected to the common source of the first and second transistors.

31 Claims, 15 Drawing Sheets

PRECISION DIFFERENTIAL SWITCHED CURRENT SOURCE

BACKGROUND OF THE INVENTION

1. Field of the Invention

The present invention relates to current sources. More particularly, the present invention relates to a high-current, high-speed, high-accuracy current driver for differentially switching accurate currents onto different loads.

2. Description of the Related Art

Accurate current sources are needed for a variety of operations, including to provide current for driving transformers in 100BaseTX networks and for use in digital-to-analog converters. In the past, current-mirror cascode type current sources have been used.

One type of conventional current source is the regulated cascode current mirror. FIG. 1 is a circuit diagram of a conventional regulated cascode current mirror.

As shown in FIG. 1, the current mirror has an input node 1, a first mirror transistor 3, a second mirror transistor 5, an output transistor 7, a voltage amplifier 9, and an output node 11. The voltage amplifier 9 is preferably a differential amplifier. The first mirror transistor 3 has its drain and gate connected to the input node 1 and its source connected to ground. The second mirror transistor 5 has its gate connected to the gate of the first mirror transistor 5, its drain connected to the source of the output transistor 7, and its source connected to ground. The output transistor 7 has its gate connected to the output of the voltage amplifier 9, its source connected to the drain of the second transistor 5, and its drain connected to the output node 11. The voltage amplifier 9 has its non-inverting input connected to a reference voltage $V_{ref}$, and its inverting input connected to the source of the output transistor 7. The input node receives an input current $I_{IN}$, and the output node 11 provides an output current $I_{OUT}$.

The operation of the regulated cascode current mirror shown in FIG. 1 is described below. An input current $I_{IN}$ is initially supplied to the input node 1. Because the gates of both mirror transistors 3 and 5 are connected to the input node 1, both transistors 3 and 5 are turned on when it receives this current input. The gate-to-source voltage for the two mirror transistors 3 and 5 is identical, since the two have a common gate voltage and a common source voltage (both sources being grounded). In addition, in the first mirror transistor 3, the drain-to-source voltage is identical with its gate-to-source voltage, since the gate and drain are connected together.

The current flowing through the second mirror transistor will depend upon how the drain-to-source voltage of the second mirror transistor 5 compares with that of the first mirror transistor 3. If the two drain-to-source voltages are identical, then the currents passing through the first and second mirror transistors 3 and 5 will be the same. As the drain-to-source voltage of the second mirror transistor 5 increases, so too does the current passing through it, and the gain of the circuit is increased. Likewise, as the drain-to-source voltage of the second mirror transistor 5 decreases, the current passing through it also decreases and the gain of the circuit is reduced.

The output transistor 7 and the voltage amplifier 9 then serve to regulate the output of the current mirror formed by the first and second mirror transistors 3 and through the use of a feedback loop, as is well understood in the art.

The current mirror of FIG. 1 only allows for a single output current, however. In many applications, e.g. digital-to-analog converters, driving transformers in 100BaseTX networks multiple output current lines are required based on a single input current. One way of providing this multiple output is through the use of a differential amplifier as a current splitter.

FIG. 2 is a circuit diagram showing a conventional differential amplifier used as a current splitter. As shown in FIG. 2, the differential amplifier comprises an input node 21, first and second transistors 23 and 25, first and second control nodes 27 and 29, and first and second output nodes 31 and 33. The first transistor 23 has its source connected to the input node 21, its drain connected to the first output node 31, and its gate connected to the first control node 27. The second transistor 25 has its source connected to the input node 21, its drain connected to the second output node 33, and its gate connected to the second control node 29. The first control nodes 27 receives the first control signal $C_1$ and controls the operation of the first transistor 23 by providing the first control signal $C_1$ to the gate of the first transistor 23. The second control nodes 29 receives the second control signal $C_2$ and controls the operation of the second transistor 25 by providing the second control signal $C_2$ to the gate of the second transistor 25. The input node 21 receives the input current $I_{IN}$; the first output node 31 provides a first output current $I_{OUT1}$ when the first transistor 23 is turned on; and the second output node 33 provides a second output current $I_{OUT2}$ when the second transistor 25 is turned on.

The operation of the differential amplifier of FIG. 2 as a current splitter is described below. The differential amplifier can provide different outputs at the two output nodes 31 and 33 depending upon the values of the first and second control signals $C_1$ and $C_2$, and whether the first and second transistors 23 and 25 are turned on. As each of the two transistors 23 and 25 is turned on, it allows some or all of the input current $I_{IN}$ to flow through it to its respective output node 31 or 33. Table 1 shows the output currents $I_{OUT1}$ and $I_{OUT2}$ for the possible combinations of $C_1$ and $C_2$.

TABLE 1

| $C_1$ | $C_2$ | $I_{OUT1}$ | $I_{OUT2}$ |
|---|---|---|---|
| 0 | 0 | 0 | 0 |
| 0 | 1 | 0 | $I_{IN}$ |
| 1 | 0 | $I_{IN}$ | 0 |
| 1 | 1 | $I_{IN}/2$ | $I_{IN}/2$ |

As shown Table 1, if $C_1$ and $C_2$ are both "0", th the first and second transistors 23 And 25 will both be turned off and no current will be able to flow through either transistor. As a result, the currents $I_{OUT1}$ and $I_{OUT2}$ at the first and second output nodes 31 and 33 will both be zero. If $C_1$ is "0" and $C_2$ is "1", then the first transistor will be turned off and the second transistors will be turned on. The input current will thus be able to flow through the second transistor 25, but not through the first transistor 23. As a result, the current $I_{OUT1}$, at the first output node 31 will be zero and the current $I_{OUT2}$ at the second output node 33 will be $I_{IN}$ Similarly, if $C_1$ is "1" and $C_2$ is "0", then the first transistor will be turned on and the second transistors will be turned off. The input current will be able to flow through the first transistor 23, but not through the second transistor 25. As a result, the current $I_{OUT1}$, at the first output node 31 will be $I_{IN}$ and the current $I_{OUT2}$ at the second output node 33 will be zero. Finally, if $C_1$ and $C_2$ are both "1", then the first transistor 23 and the second transistor 25 will both be turned on, and the input current $I_{IN}$ will be able to flow through both the first transistor 23 and the second transistor 25. As a result, the current $I_{OUT1}$ at the first output node 31 and the current $I_{OUT2}$ at the second output node 33 will both be $I_{IN}/2$.

To insure an accurate current division, it is preferable to keep the conductive transistors in saturation.

If the difference between the two output currents $I_{OUT1}$ and $I_{OUT2}$ is taken for each of these possible control input situations, three separate current results are possible, $+I_{IN}$, $-I_{IN}$, or 0. Thus, a single input current can be transformed into multiple different output currents. In a similar manner, by transforming the output currents to voltages and taking the difference between the output voltages, three different output voltages can be generated depending upon the values of the control signals $C_1$ and $C_2$.

However, the conventional differential amplifier current source does not allow a very high voltage swing at the outputs because of the digitally controlled transistors 23 and 25 placed in series with the current source from the input node 21. This is because the first and second control nodes 27 and 29 must stay in saturation, and too high a voltage swing will bring the first and second control nodes 27 and 29 out of saturation.

SUMMARY OF THE INVENTION

It is thus an object of the present invention to overcome or at least minimize the various drawbacks associated with conventional techniques for providing accurate, differentially switched currents onto different loads.

It is another object of the present invention to provide differentially switched current source that can rapidly switch between various outputs, yet maintain the desired level of accuracy.

According to one aspect of the present invention, a switched current source is provided, comprising: a differential amplifier used as a controlled current switch, having a current input, a first control input connected to a first node, a second control input connected to a second node, and first and second current outputs; a voltage amplifier, having a first amplifier input connected to a reference voltage, a second amplifier input connected to the current input, and an amplifier output connected to an amplifier output node; a first switch connected between the amplifier output and the first node, and being controlled by a first control input; a second switch connected between the amplifier output and the second node, and being controlled by a second control input; a third switch connected between the current input and the first node, or to a reference node, and being controlled by a third control input; and a fourth switch connected between the current input and the second node, and being controlled by a fourth control input.

According to another aspect of the present invention, a first current source is provided for providing a first current to the current input and the first current source comprises: a second current source; and a first current mirror connected to the second current source and operating to provide the first current to the current input node.

According to yet another aspect of the present invention, the differential amplifier comprises: a first differential transistor having its gate connected to the first node, its source connected to the current input node, and its drain connected to the first current output; and a second differential transistor having its gate connected to the second node, its source connected to the current input, and its drain connected to the second current output.

According to still another aspect of the invention, a switched current source is provided, comprising: a first differential transistor having its gate connected to a first intermediate node, its source connected to an input node, and its drain forming a first output node; a second differential transistor having its gate connected to a second intermediate node, its source connected to the ink node, and its drain forming a second output node; a voltage amplifier, having a first amplifier input connected to a reference voltage, a second amplifier input connected to the input node, and an amplifier output; a first switching transistor connected between the voltage amplifier and the first intermediate node, having its gate connected to a first control input; a second switching transistor connected between the voltage amplifier and the second intermediate node, having its gate connected to a second control input; a third switching transistor connected between the input node and the first intermediate node, having its gate connected to a third control input; and a fourth switching transistor connected between the input node and the second intermediate node, having its gate connected to a fourth control input.

BRIEF DESCRIPTION OF THE DRAWINGS

The above and other objects and advantages of the present invention will become readily apparent from the description that follows, with reference to the accompanying drawings, in which.

DETAILED DESCRIPTION OF THE PREFERRED EMBODIMENTS

The present invention employs a novel switching design to improve the speed and accuracy of a differentially switched current source.

Figure 1:
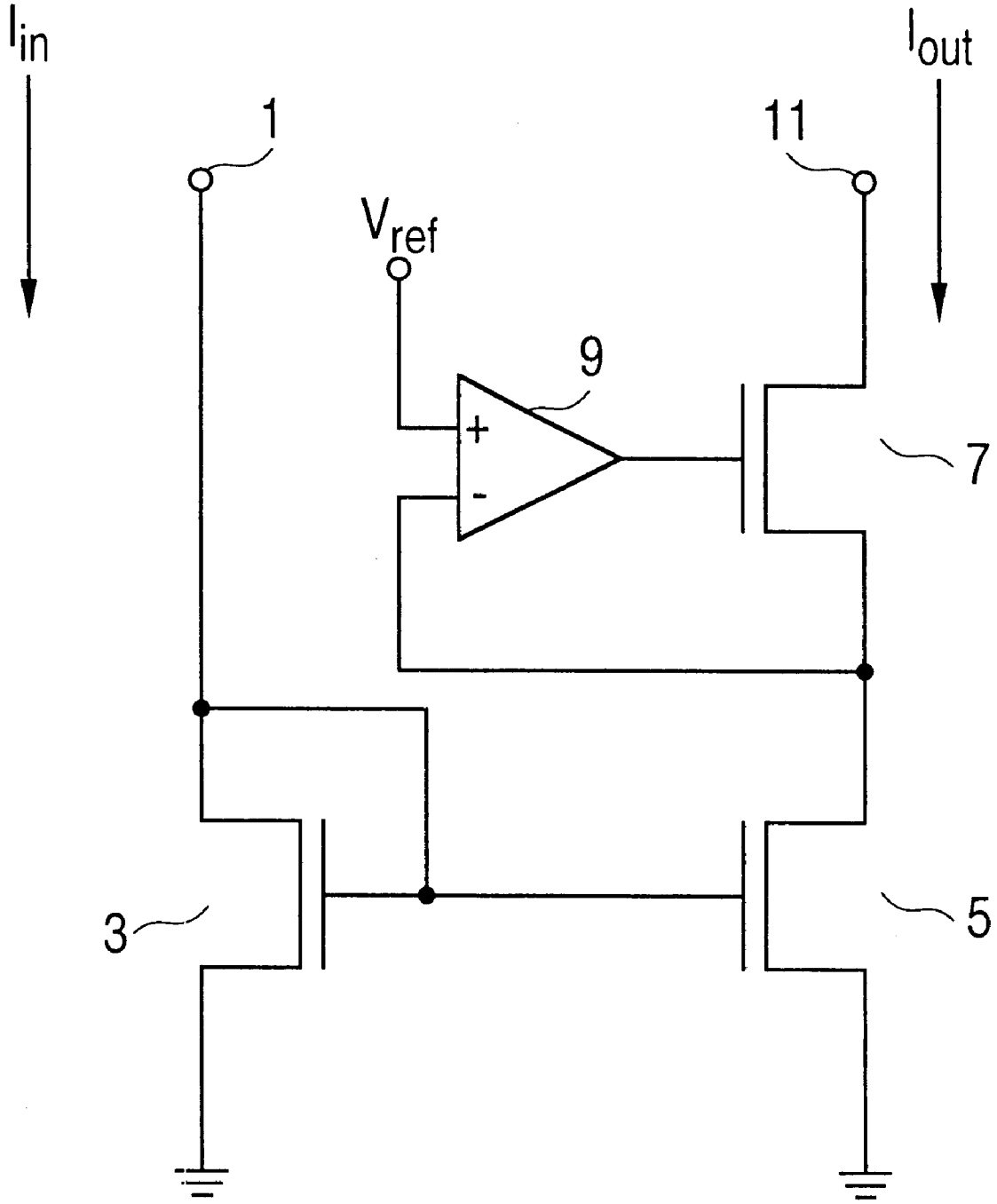
FIG. 1 (PRIOR ART)
FIG. 1 is a circuit diagram showing a conventional regulated cascode current mirror.
Figure 2:
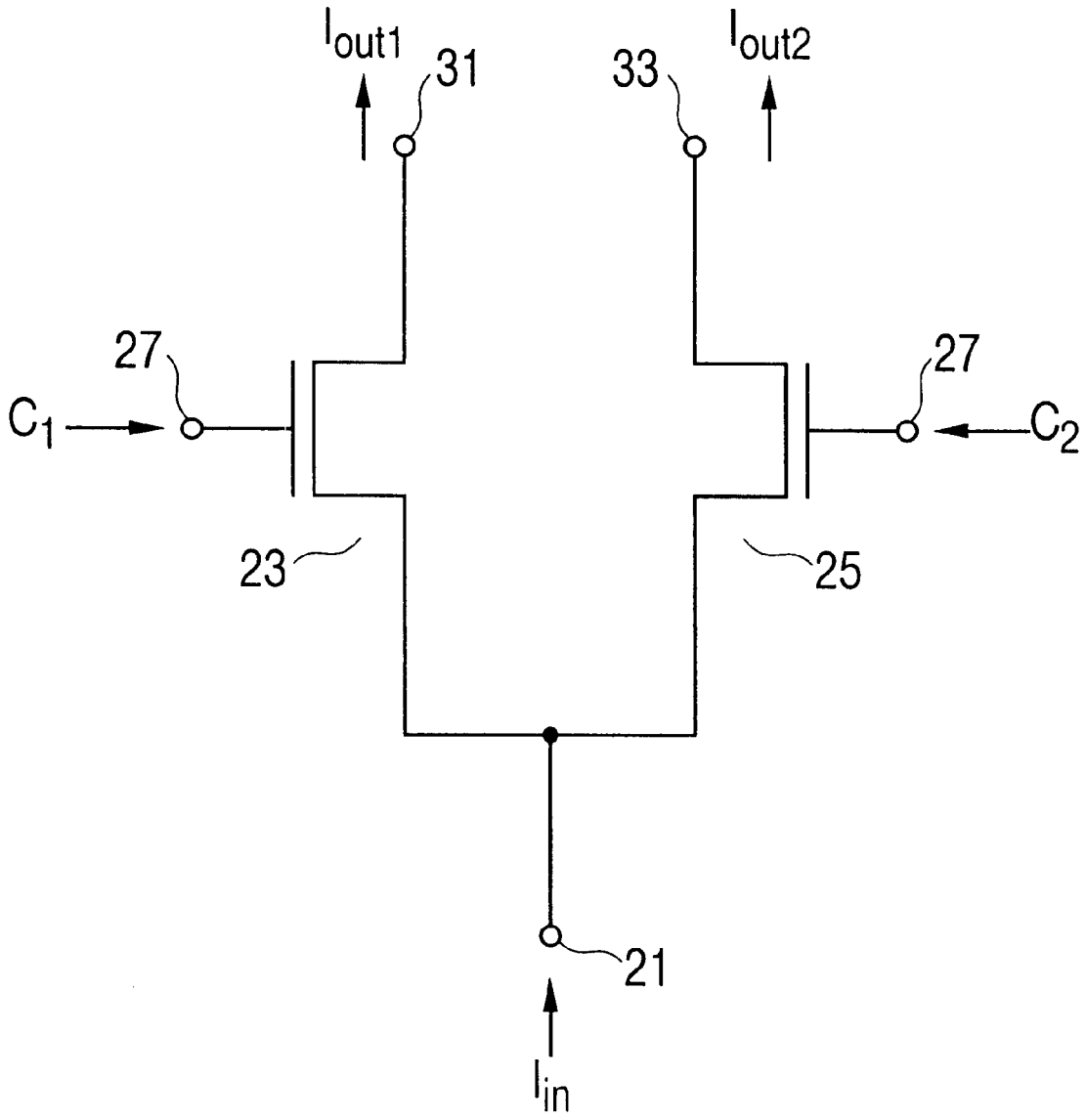
FIG. 2 (PRIOR ART)
FIG. 2 is a circuit diagram showing a conventional differentially switched current source.
Figure 3A:
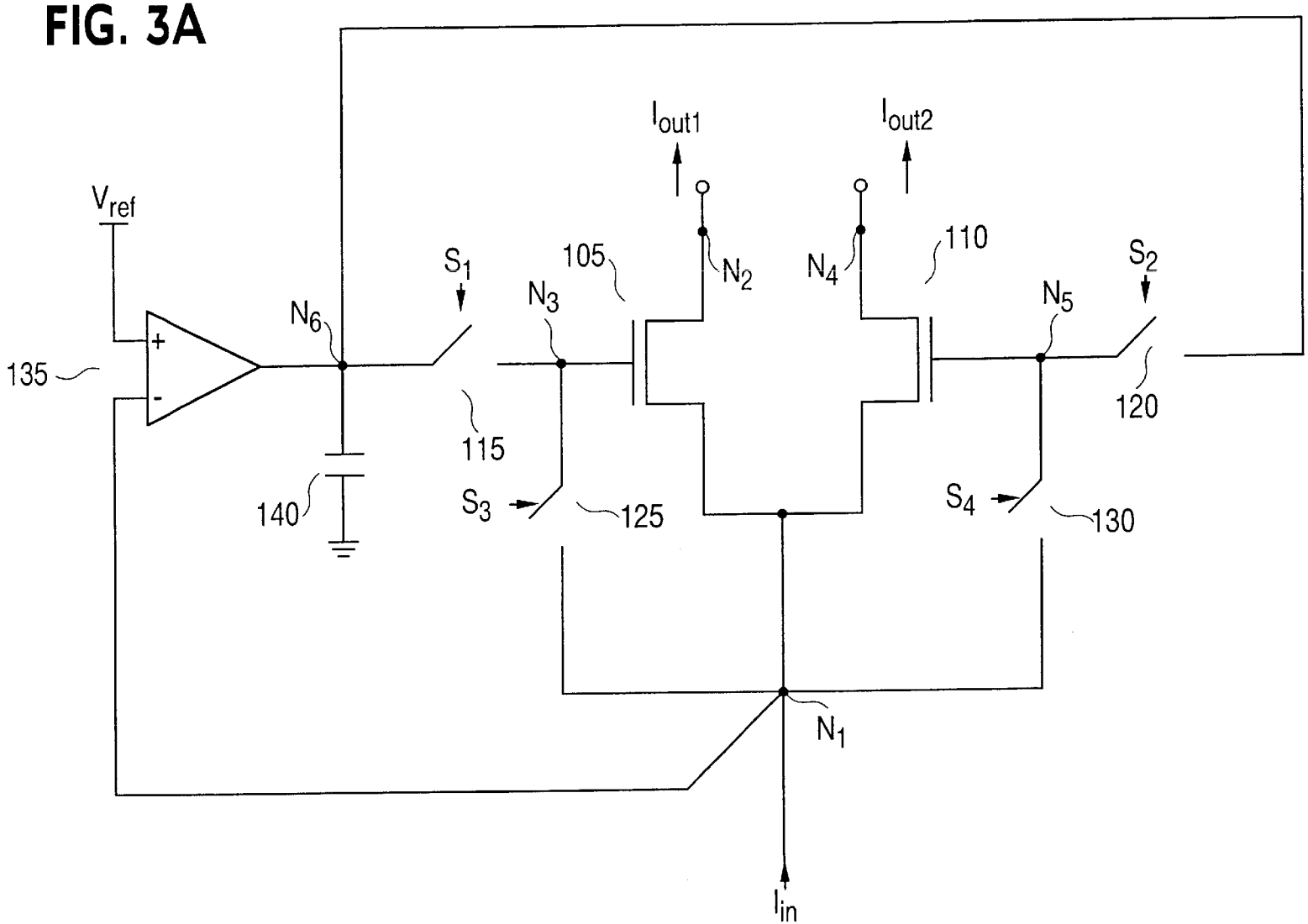
FIG. 3A is circuit diagram showing a differential current switch according to a first preferred embodiment of the present invention.

FIG. 3A shows a differential current switch accord to a first preferred embodiment of the present invention. As shown in FIG. 3, the switched current source includes first and second differential transistors 105 and 110, first through fourth switches, 115, 120, 125, and 130, a voltage amplifier 135, and a capacitor 140.

The first differential transistor 105 has its source connected to an input node $N_1$, its drain connected to a first output node $N_2$, and its gate connected to a first control node $N_3$. The second differential transistor 110 has its source connected to the input node $N_1$, its drain connected to a second output node $N_4$, and its gate connected to a second control node $N_5$. Connected in this manner, the first and second differential transistors 105 and 110 form a differential amplifier. In this embodiment the parameters of the first and second differential transistors 105 and 110 are chosen to be identical to allow for an even differentiation of the input current $I_{IN}$. In alternate embodiments, different parameters could be used to obtain a desired current differentiation ratio when both differential transistors are on.

The voltage amplifier 135 has its non-inverting input connected to a reference voltage, its inverting input connected to the input node $N_1$, and its output connected to an amplifier output node $N_6$. The capacitor 140 is connected between the amplifier output node $N_6$ and ground and operates to compensate the frequency response of certain feedback amplifiers and to store the potential of the amplifier output node during transients.

The first switch 115 is connected between the first control node $N_3$ and the amplifier output node $N_6$ and is controlled by a first control signal $S_1$. The second switch 120 is connected between the second control node $N_5$ and the amplifier output node $N_6$ and is controlled by a second control signal $S_2$. The third switch 125 is connected between the first control node $N_3$ and the input node $N_1$ and is controlled by a third control signal $S_3$. The fourth switch 130 is connected between the second control node $N_5$ and the input node $N_1$ and is controlled by a fourth control signal $S_4$.

The first and second switches 115 and 120 operate to select one or both of the first and second differential transistors 105 and 110 to allow the chosen transistor(s) to pass some or all of the input current $I_{IN}$ to one or both of the output nodes $N_2$ and $N_4$. The third and fourth switches 125 and 130 operate to rapidly pull down the first and second differential transistors 105 and 110, respectively, when they are not chosen, so that the transistor gates will not remain floating. This novel design increases the operating speed and efficiency of the system and allows for greater switching accuracy.

Because of their respective functions, the first and third switches 115 and 125 are always in opposite positions, as are the second and fourth switches 120 and 130. In other words, when the first switch 115 is open, the third switch 125 is closed, and when the first switch 115 is closed, the third switch 125 is open. The same relationship exists between the second and fourth transistors 120 and 130. The reason for this can easily be seen by looking, for example, at the operation of the first differential transistor 105. When the first differential transistor 105 is activated, the first switch 115 is closed so that the first differential transistor 105 is turned on. The third switch 125 is left open, since the first differential transistor 105 is turned on and should not be pulled down. Likewise, when the first differential transistor 105 is deactivated, the first switch 115 is left open to place the first differential transistor 105 in an off state. The third switch 125 is then closed to pull down the first differential transistor 105 and keep its gate from floating, since it is deactivated and its gate would otherwise begin to float.

As a result of this design, there are no circumstances when the first and third switches 115 and 125 will both be closed or will both be open. If both were closed, then the circuit would try to both drive and pull down the first differential transistor 105 at the same time. If both were opened, the first differential transistor 105 would not be turned on, but its gate would be allowed to float. Both of these conditions would be disadvantageous to the operation of the switched current source and should be avoided. For similar reasons, there are also no circumstances when the second and fourth switches 120 and 130 will both be closed or will both be open.

Because of this relationship between the first and third switches 115 and 125, and between the second and fourth switches 120 and 130, only two control signals $S_1$ and $S_2$ are required to properly control the first through fourth switches 115, 120, 125, and 130. The first control signal $S_1$ can actually be used as a source of both the first control signal $S_1$ and the third control signal $S_3$. Similarly, the second control signal $S_2$ can be used as a source of both the second control signal $S_2$ and the fourth control signal $S_4$. If all of the switches are controlled in the same manner, the first and second control signals $S_1$ and $S_2$ will have to be run through inverters to obtain the control signals $S_3$ and $S_4$, respectively. But, if the switches are designed such that the first and third switches are activated by opposite signals and the second and fourth switches are activated by opposite signals, then the first and second control signals $S_1$ and $S_2$ can function directly as the third and fourth control signals $S_3$ and $S_4$, respectively. In other words, if the first switch 115 is opened by a "high" signal and closed by a "low" signal, and the third switch is opened by a "low" signal and closed by a "high" signal, then the same control signal can be used for the two switches.

The operation of the switched current source of FIG. 3 is described below. The switched current source provides different outputs at the first and second output nodes $N_2$ and $N_4$ depending upon the values of the first through fourth control signals $S_1$ and $S_4$, and whether the first and second differential transistors 105 and 110 are turned on. As each of the two transistors 105 and 110 is turned on, it allows some or all of the input current $I_{IN}$ to flow through it to its respective output node $N_2$ or $N_4$. Table 2 shows the output currents $I_{OUT1}$ and $I_{OUT2}$ for the possible combinations of $S_1$ through $S_4$.

TABLE 2

| $S_1$ | $S_2$ | $S_3$ | $S_4$ | $I_{OUT1}$ | $I_{OUT2}$ |
|---|---|---|---|---|---|
| 0 | 0 | 1 | 1 | 0 | 0 |
| 0 | 1 | 1 | 0 | 0 | $I_{IN}$ |
| 1 | 0 | 0 | 1 | $I_{IN}$ | 0 |
| 1 | 1 | 0 | 0 | $I_{IN}/2$ | $1_{IN}/2$ |

As shown in Table 2, if $S_1$ and $S_2$ are both "0", and $S_3$ and $S_4$ are both "1" the first and second switches 115 and 120 will be opened and the third and fourth switches 125 and 130 will be closed. Thus, the first and second differential transistors 105 and 110 will both be turned off and will be rapidly pulled down to keep their gates from floating. As a result, no current will be able to flow through either transistor and the currents $I_{OUT1}$ and $I_{OUT2}$ at the first and second output nodes $N_2$ and $N_4$ will both be zero.

If $S_1$ is "1", $S_2$ is "0", $S_3$ is "0", and $S_4$ is "1", then the first and fourth switches 115 and 130 will be closed and the second and third switches 120 and 125 will be opened. The first differential transistor 105 will thus be turned on and the second differential transistor 110 will be turned off and quickly pulled down to prevent if from floating. The input current $I_{IN}$ will thus be able to flow through the first differential transistor 105, but not through the second differential transistor 110. As a result, the current $I_{OUT1}$ at the first output node $N_2$ will be equal to $I_{IN}$ and the current $I_{OUT2}$ at the second output node $N_4$ will be zero.

Similarly, if $S_1$ is "0", $S_2$ is "1", $S_3$ is "1", and $S_4$ is "0", then the first and fourth switches 115 and 130 will be opened and the second and third switches 120 and 125 will be closed. In this case, the second differential transistor 110 will be turned on and the first differential transistor 105 will be turned off and quickly pulled down to prevent if from floating. The input current $I_{IN}$ will thus be able to flow through the second differential transistor 110, but not through the first differential transistor 105. As a result, the current $I_{OUT1}$ at the first output node $N_2$ will be zero and the current $I_{OUT2}$ at the second output node $N_4$ will be $I_{IN}$.

Finally, if $S_1$ and $S_2$ are both "1" and $S_3$ and $S_4$ are both "0", then the first and second switches 115 and 120 will both be closed and the third and fourth switches 125 and 130 will both be opened. Thus, the first differential transistor 105 and the second differential transistor 110 will both be turned on and the input current $I_{IN}$ will be able to flow through both the first differential transistor 105 and the second differential transistor 110. Since the two transistors have similar parameters, the current will flow equally between them and so the current $I_{OUT1}$ at the first output node $N_2$ and the current $I_{OUT2}$ at the second output node $N_4$ will both be equal to $I_{IN}/2$.

As with the conventional differential amplifier, if the difference between the two output currents $I_{OUT1}$ and $I_{OUT2}$ is taken, three separate current results are possible $+I_{IN}$, $-I_{IN}$, or 0. Thus, a single input current can be transformed into multiple different output currents. Also, as with conventional designs by transforming the output currents to voltages and taking the difference between the output voltages, three different output voltages can be generated depending upon the values of the control signals $S_1$ to $S_4$.

Figure 3B:
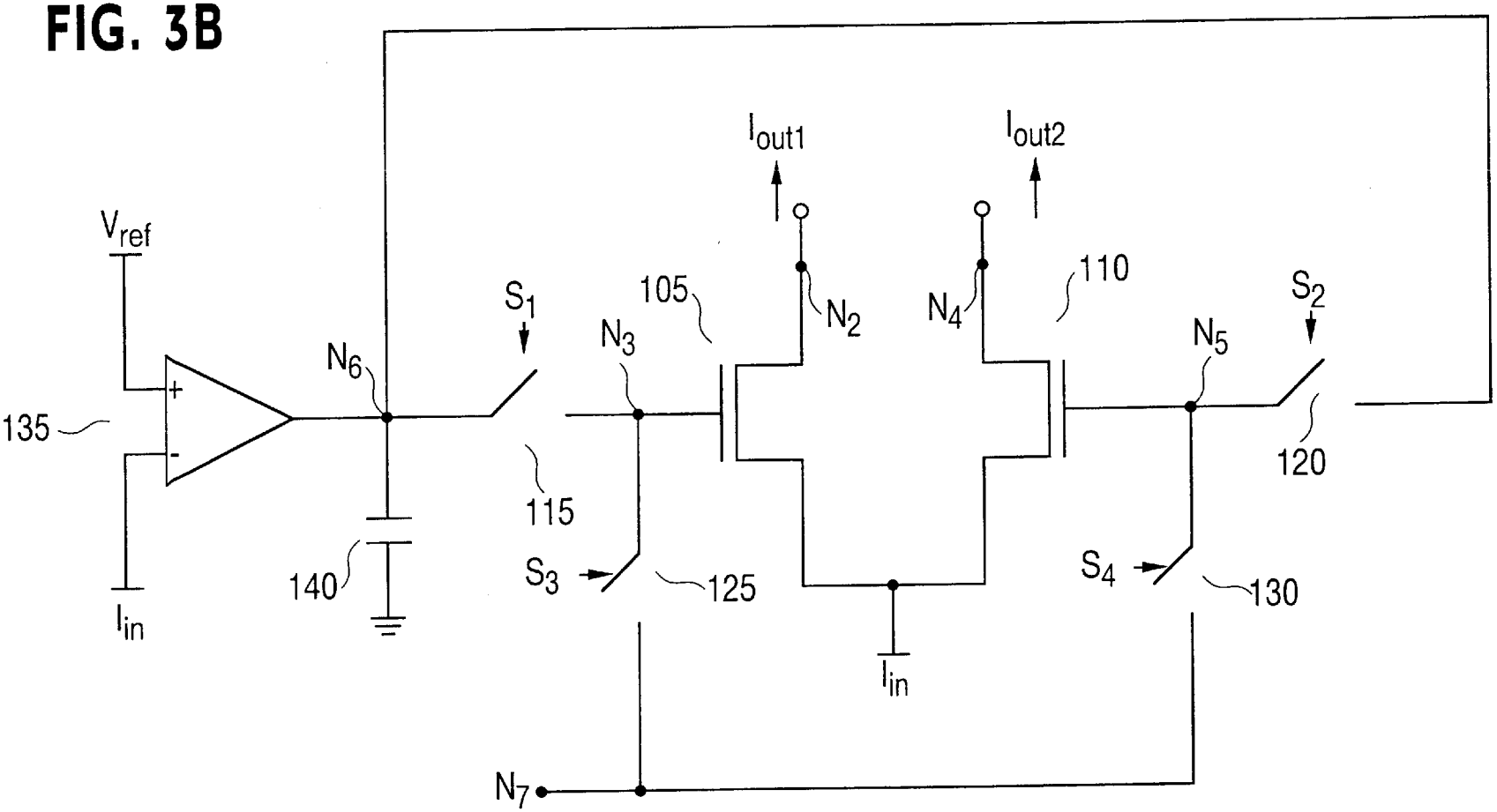
FIG. 3B is circuit diagram showing a differential current switch according to a second preferred embodiment of the present invention.

FIG. 3B shows a differential current switch according to a second preferred embodiment of the present invention. The circuit of FIG. 3B is substantially the same as that of FIG. 3A, except for the connections of the fourth and fifth switches.

As in the first preferred embodiment, the first switch 115 is connected between the first control node $N_3$ and the amplifier output node $N_6$ and is controlled by a first control signal $S_1$. Likewise the second switch 120 is connected between the second control node $N_5$ and the amplifier output node $N_6$ and is controlled by a second control signal $S_2$.

However, the third switch 125 is connected between the first control node $N_3$ and a reference node $N_7$, but is still controlled by a third control signal $S_3$. The fourth switch 130 is connected between the second control node $N_5$ and the reference node $N_7$ and is controlled by a fourth control signal $S_4$. This reference node $N_7$ may be ground.

Figure 4:
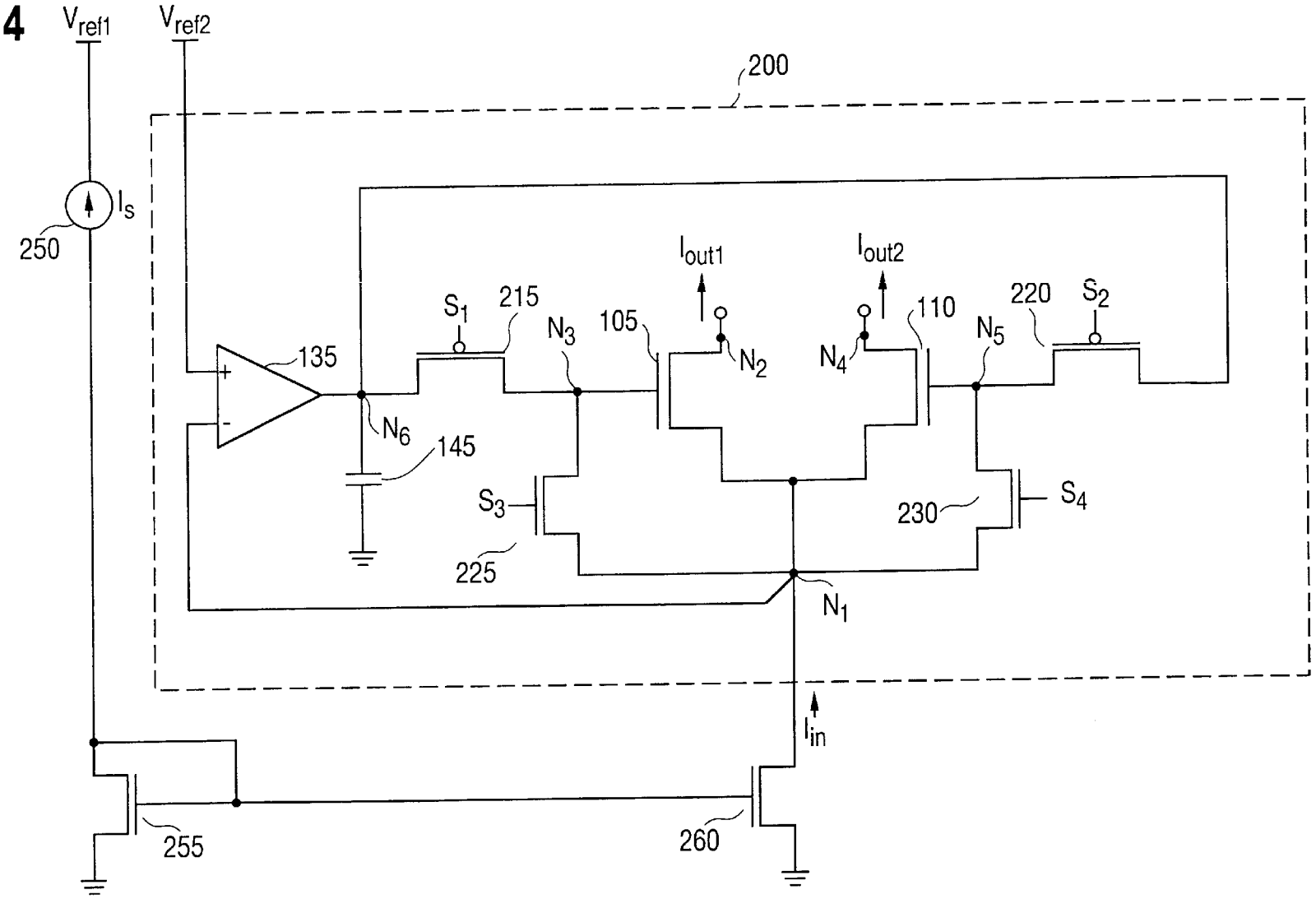
FIG. 4 is a circuit diagram showing one transistor-based implementation of circuit of FIG. 3A, according to a third preferred embodiment of the present invention.

FIG. 4 shows a switched current source according to a third preferred embodiment of the present invention. The circuit shown in FIG. 4 is similar to the first preferred embodiment shown in FIG. 3A, except that it includes a first current source 250, a first mirror transistor 255, and a second mirror transistor 260, which serve to provide the input current $I_{IN}$ to the differential current switch 200. Also, in the differential current switch 200, the first through fourth switches 115, 120, 125, and 130 are replaced with first through fourth switching transistors 215, 220, 225, and 230. In this embodiment, the switching transistors are preferably MOS transistors.

The first current source 250 provides a supply current of $I_5$ to the drain of the first mirror transistor 255, and is connected to a first reference voltage $V_{ref1}$ The first and second mirror transistors 255 and 260 are connected together as a current mirror. The gate and drain of the first mirror transistor 255 are connected together, and the gate of the second mirror transistor 260 is connected to the gate of the first mirror transistor 255. Both the first and second mirror transistors 255 and 260 have their source Connected to ground.

The current mirror formed by the first and second mirror transistors 255 and 260 receives the supply current $I_S$ from the first current source 250 and supplies the input current $I_{IN}$ to the first node $N_1$.

In the current mirror of FIG. 4, it is necessary for the second mirror transistor 260 to have substantially the same drain-to-source voltage as the first mirror transistor 255. In order to better accomplish this voltage equality, a negative feedback loop is closed around the transistors in the differential amplifier that are turned on. The feedback loop connects the common source of the first and second differential transistors 105 and 110 to the respective gate or gates of the first and second differential transistors (depending upon which are turned on) through the voltage amplifier 135. In this way, during each of the possible configurations where one or both of the differential transistors 105 and 110 are turned on, the circuit of FIG. 4 forms a high-swing, precision, regulated-gate cascode current mirror to one or both of the output nodes $N_2$ and $N_4$.

The non-inverting input of the voltage amplifier 135 is connected to a second reference voltage $V_{ref2}$, substantially equal to the gate-source voltage of the first mirror transistor 255.

Figure 5A:
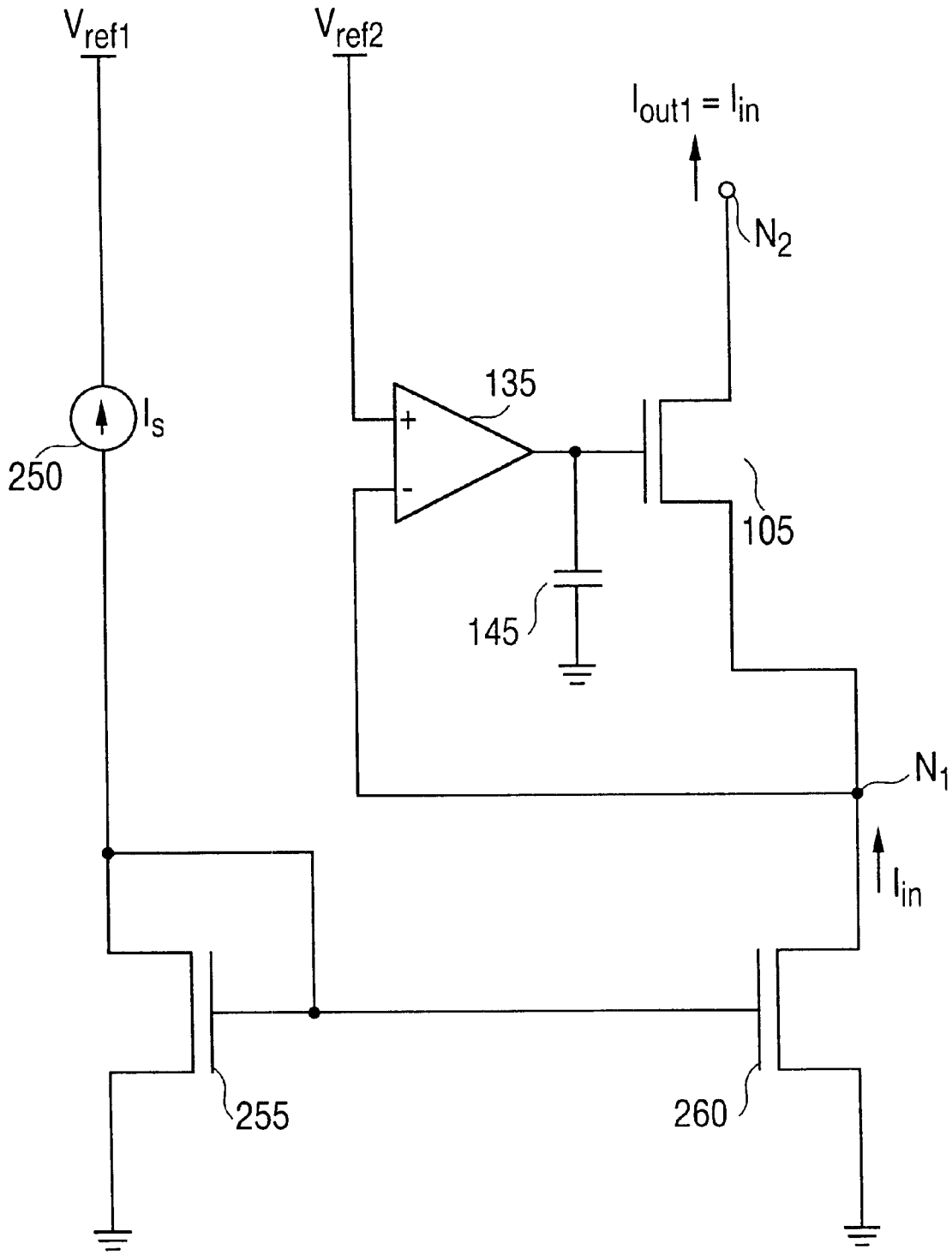
FIGS. 5A through 5C are circuit diagrams showing the functioning of the circuit of FIG. 4 for various settings of the first through fourth switches.
Figure 5B:
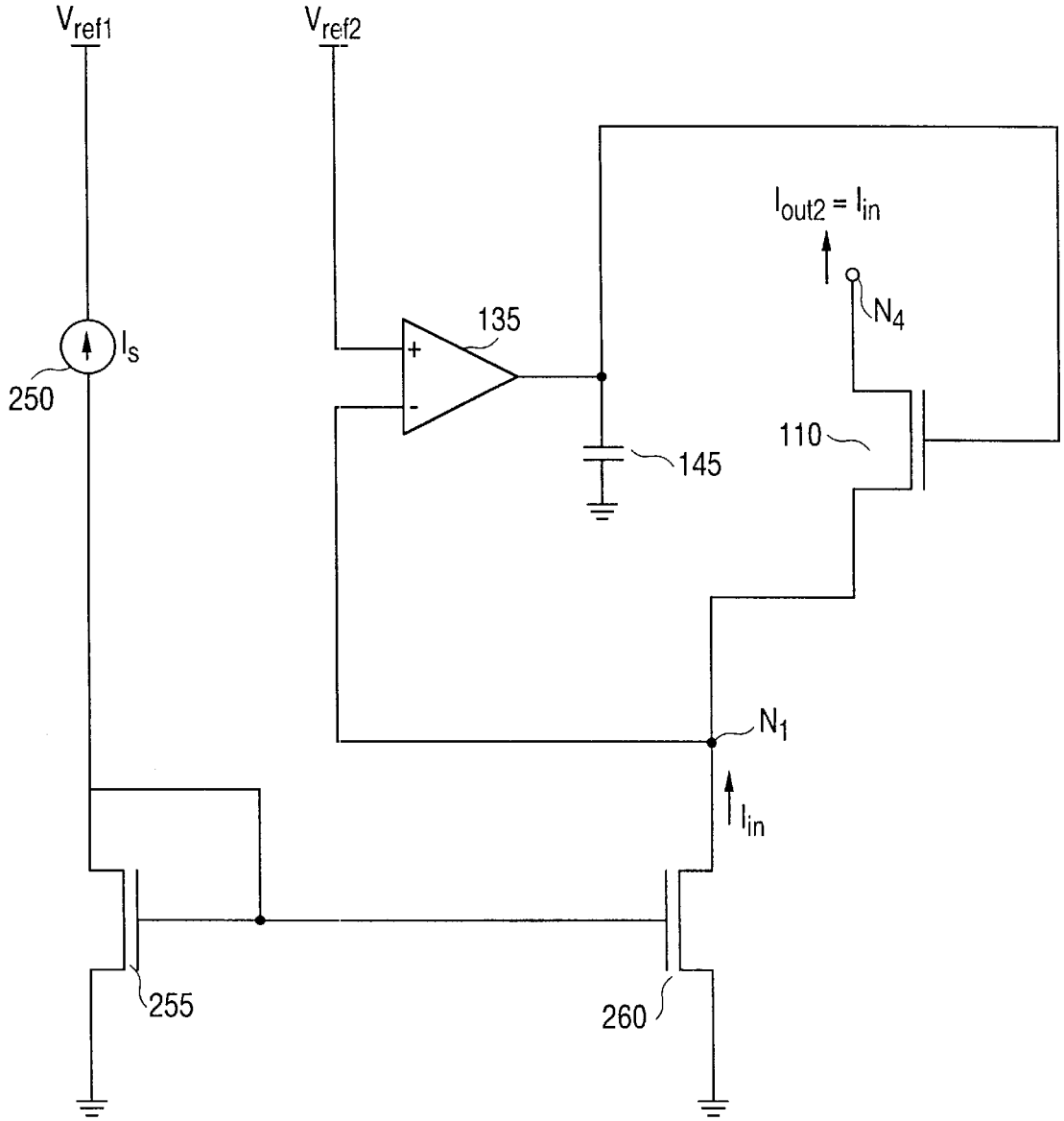
Figure 5C:
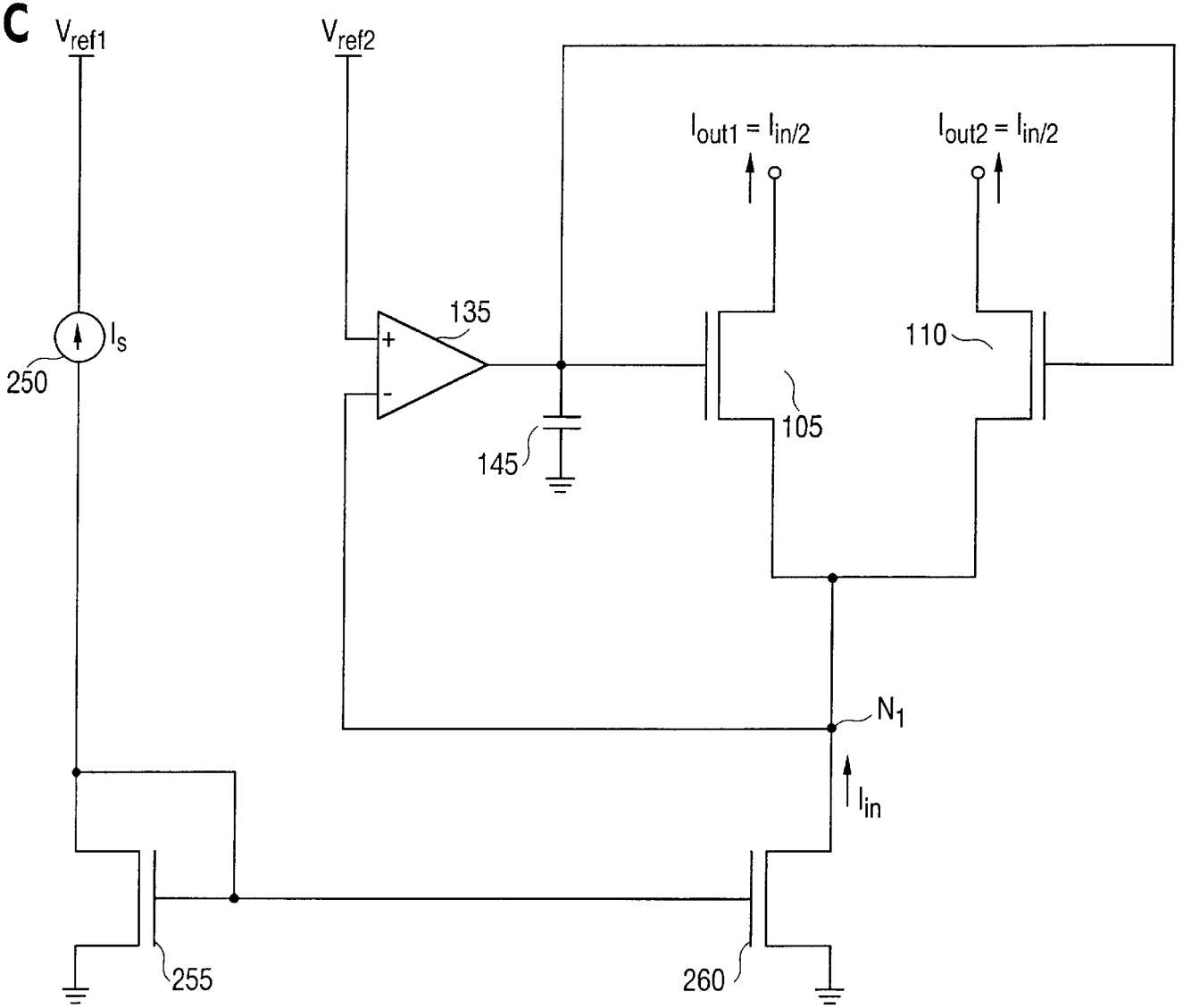

FIGS. 5A through 5C are circuit diagrams showing the functioning of the circuit of FIG. 4 for various configurations of the first through fourth switching transistors 215, 220, 225, and 230. Since FIGS. 5A through 5C each address only one specific setting of the switching transistors 215, 220, 225, and 230, they each replace the switching transistors 215, 220, 225, and 230 with their functional equivalents for that particular setting, i.e., short circuits for "on" transistors, and open circuits for "off" transistors. In addition, to make the functioning circuits more clear, FIGS. 5A through 5C each omit the parts of the circuit that are short-circuited due to switching or differential transistors that are turned off.

FIG. 5A shows the situation where the control signals are set as follows: $S_1$ is "0", $S_2$ is "1", $S_3$ is "0", and $S_4$ is "1". In this case, the first and fourth switching transistors 215 and 230 will be on and the second and third switching transistors 220 and 225 will be off. The first differential transistor 105 will thus be turned on and the second differential transistor 110 will be turned off and quickly pulled down to prevent if from floating.

As shown in FIG. 5A, the effective circuit resulting from this switch configuration is a regulated cascode current mirror comprising the first differential is transistor 105, the first and second mirror transistors 255 and 260, the voltage amplifier 135, and the capacitor 145. In this circuit, the input current $I_{IN}$ will be able to flow through the first differential transistor 105, but not through the second differential transistor 110. As a result, the current $I_{OUT1}$ at the first output node $N_2$ will be $I_{IN}$ and the current $I_{OUT2}$ at the second output node $N_4$ (not shown in FIG. 5A) will be zero.

Similarly, FIG. 5B shows the situation where the control signals are set as follows, $S_1$ is "1", $S_2$ is "0", $S_3$ is "1", and $S_4$ is "0." In this case, the first and fourth switching transistors 215 and 230 will be off and the second and third switching transistors 220 and 225 will be on. The second differential transistor 110 will thus be turned on and the first differential transistor 105 will be turned off and quickly pulled down to prevent if from floating.

As shown in FIG. 5B, the effective circuit resulting from this switch configuration is a regulated-gate cascode current mirror comprising the second differential transistor 110, the first and second mirror transistors 255 and 260, the voltage amplifier 135, and the capacitor 145. In this circuit, the input current $I_{IN}$ will be able to flow through the second differential transistor 110, but not through the first differential transistor 105. As a result, the current $I_{OUT1}$ at the first output node $N_2$ (not shown in FIG. 5B) will be zero and the current $I_{OUT1}$ at the second output node $N_4$ will be $I_{IN}$.

FIG. 5C shows the situation where $S_1$ is "0", $S_2$ is "0", $S_3$ is "0", and $S_4$ is "0." In this case, the first and second switching transistors 215 and 220 will be on and the third and fourth switching transistors 225 and 230 will be off. In this configuration the first and second differential transistors 105 and 110 will both be turned on.

As shown in FIG. 5C, the effective circuit resulting from this switch configuration is a dual-output regulated cascode current mirror comprising the first and second differential transistors 105 and 110, the first and second mirror transistors 255 and 260, the voltage amplifier 135, and the capacitor 145, In this circuits the input current $I_{IN}$ will be able to flow through both the first differential transistor 105 and the second differential transistor 110. As a result, the current $I_{OUT1}$ at the first output node $N_2$ and the current $I_{OUT2}$ at the second output node $N_4$ will both be $I_{IN}/2$.

Figure 6:
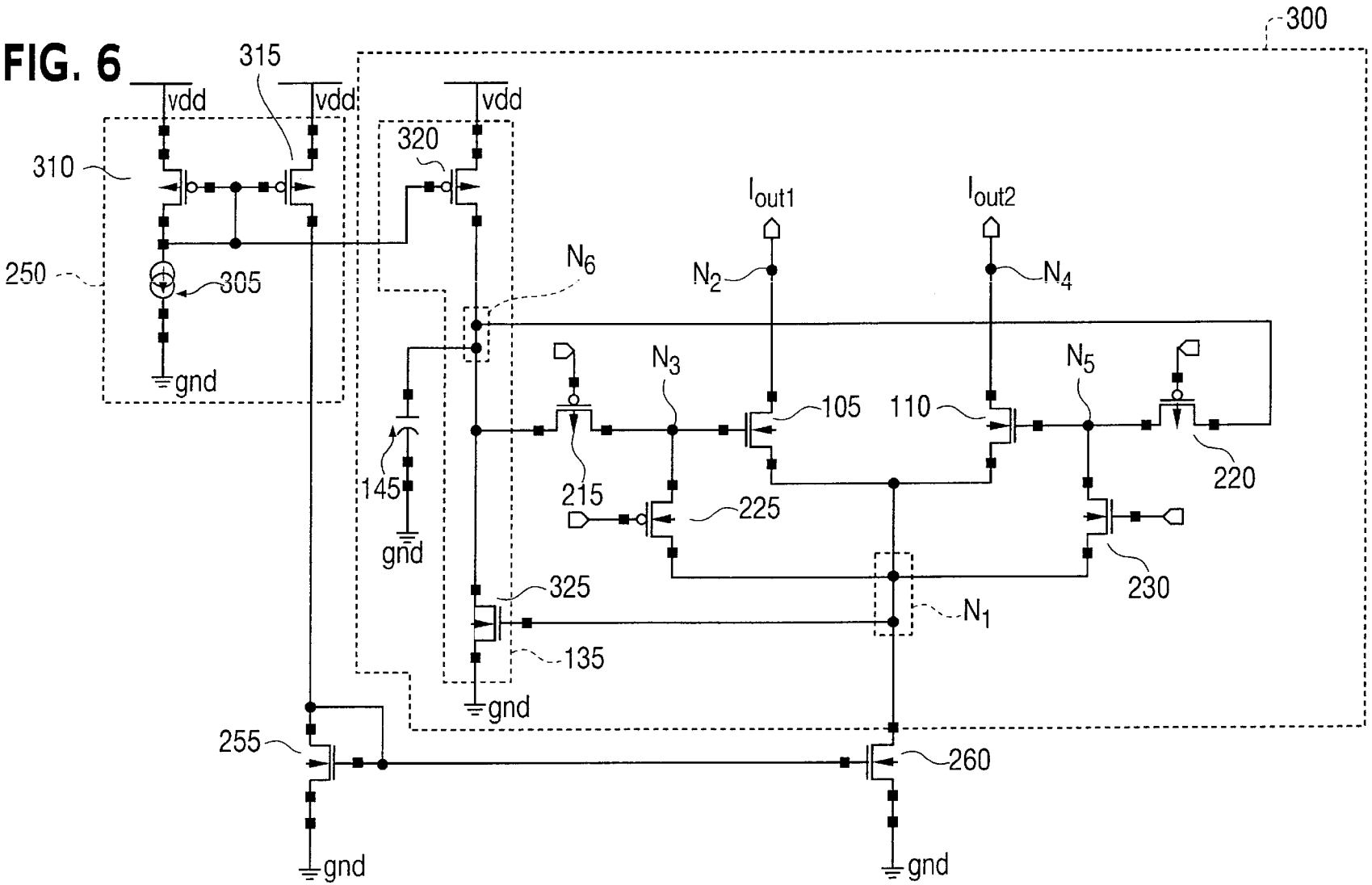
FIG. 6 is a circuit diagram showing a switched current source according to a fourth preferred embodiment of the present invention.

FIG. 6 shows a switched current source according to a fourth preferred embodiment of the present invention. This embodiment is similar to the third preferred embodiment, except as noted below. The circuit shown in FIG. 6 more specifically defines the first current source 250 and the voltage amplifier 135 in the differential current switch 300. In the fourth preferred embodiment, the first current source 250 comprises a second current source 305, and third and fourth mirror transistors 310 and 315. The voltage amplifier 135 is an inverting amplifier comprising first and second amplifying transistors 320 and 325.

As shown in FIG. 6, the fourth preferred embodiment operates to make sure that the current mirror formed by the first and second mirror transistors 255 and 260 accurately mirrors the source current 1s to supply the proper input current $I_{IN}$ to the input node $N_1$. As with the circuit in FIG. 4, it is necessary for the second mirror transistor 260 to have substantially the same drain-to-source voltage as the first mirror transistor 255. In order to accurately accomplish this voltage equality, a negative feedback loop is closed around the transistors in the differential amplifier that are turned on. The feedback loop connects the common source of the first and second differential transistors 105 and 110 to the respective gate or gates of the first and second differential transistors (depending upon which are turned on) through the first and second amplifying transistors 320 and 325 in the voltage amplifier 135.

In the voltage amplifier 135, the first amplifying transistor 320 is preferably a PMOS transistor and the second amplifying transistor is preferably an NMOS transistor. In this embodiment, the first amplifier transistor 320 has its gate connected to the second current source 305, to allow the first amplifier transistor 320 to operate as an amplifier current source.

The size of the second amplifying transistor 325 and the current through the first and second amplifying transistors 320 and 325 are sized so as to meet the following equality:

$$V_{GS325}=V_{DS255} \quad (1)$$

where $V_{GS325}$ is the gate-source voltage of the second amplifying transistor 325, and $V_{DS255}$ is the drain-source voltage of the first mirror transistor 255.

As with the circuit of FIG. 4, in each of the possible configurations where one or both of the differential transistors 105 and 110 are turned on, the circuit of FIG. 6 forms a high-swing, precision, regulated-gate cascode current mirror to one or both of the output nodes $N_2$ and $N_4$.

Figure 7A:
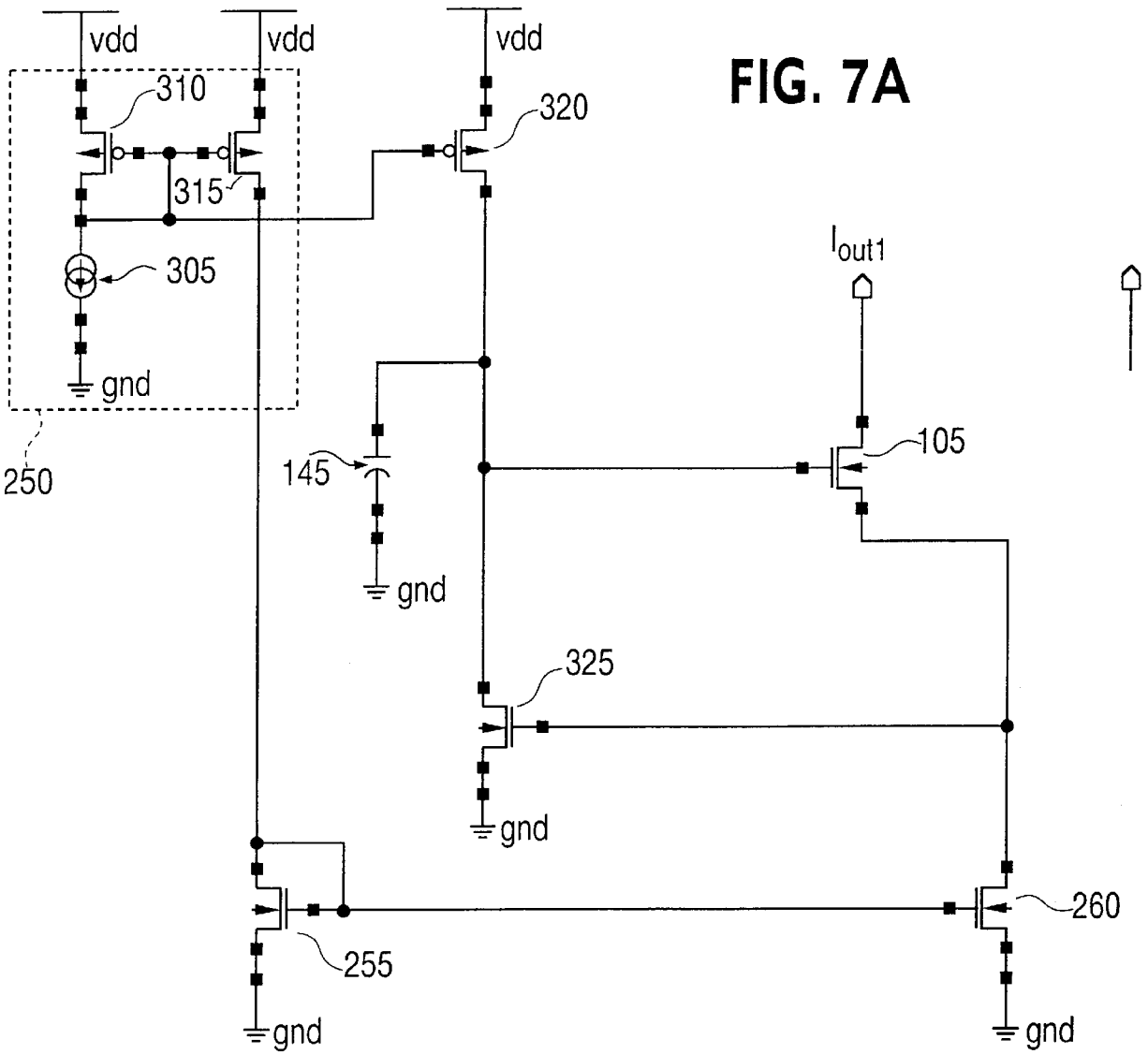
FIGS. 7A through 7C are circuit diagrams showing the functioning of the circuit of FIG. 6 for various settings of the first through fourth switching transistors.
Figure 7B:
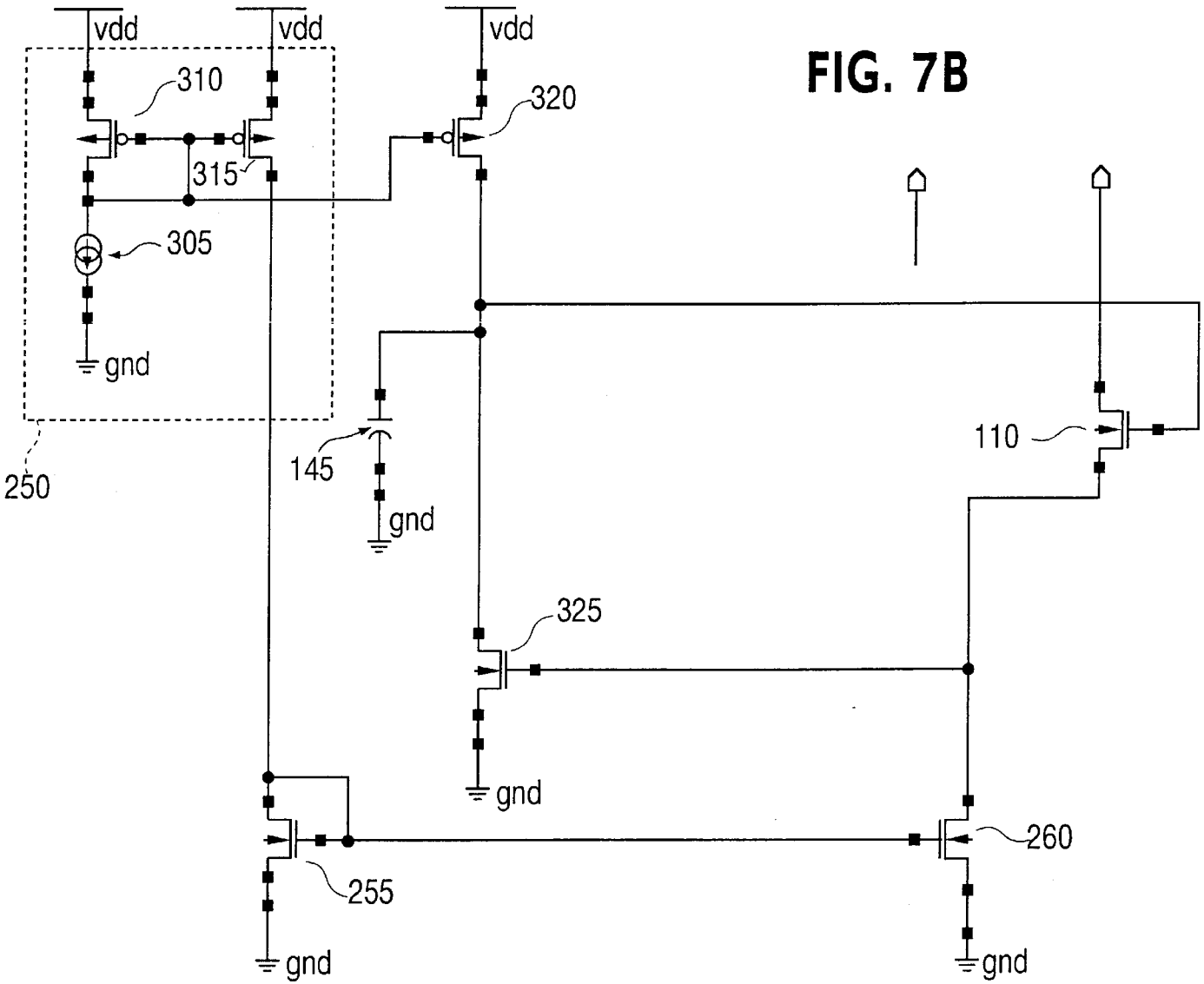
Figure 7C:
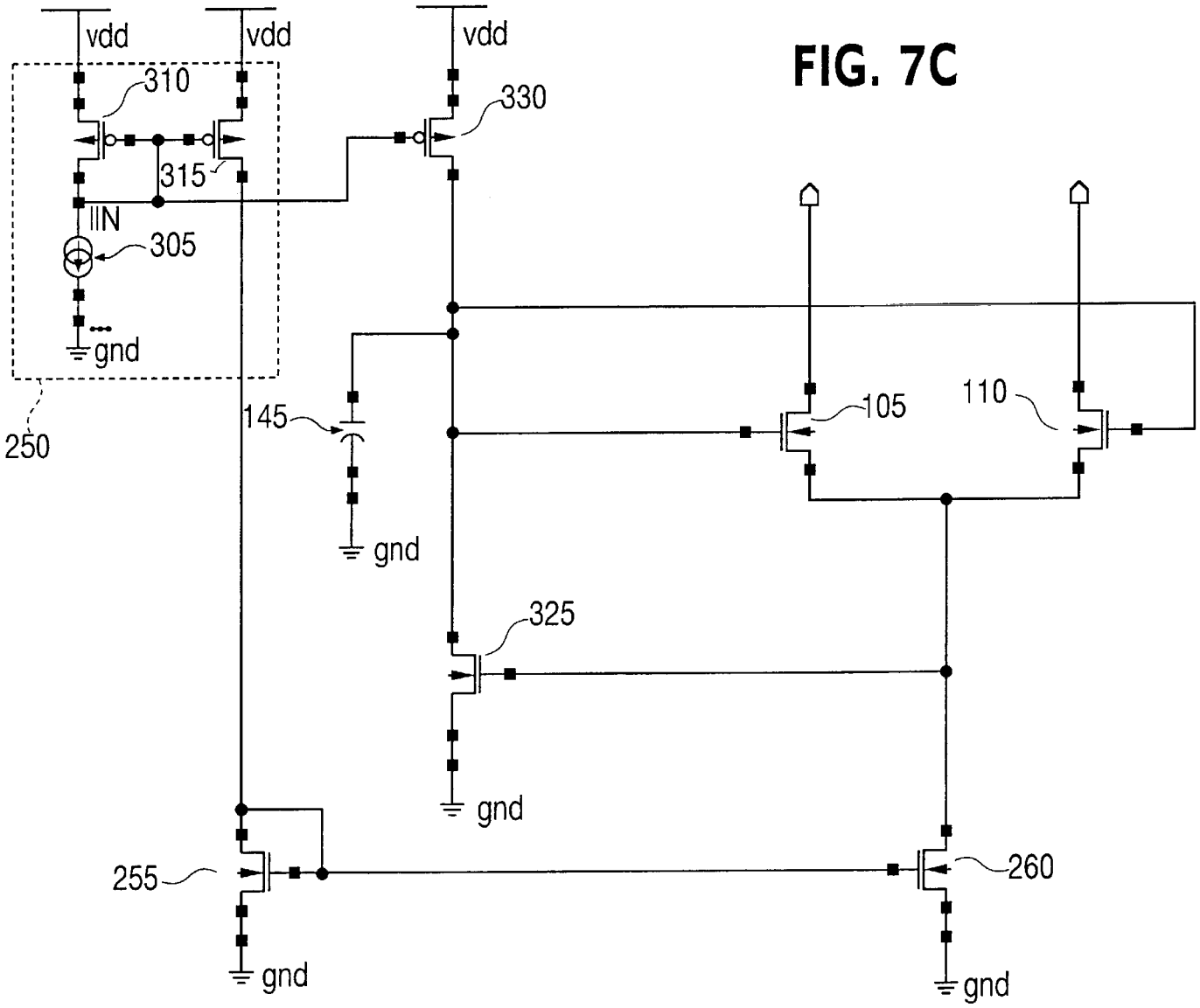

FIGS. 7A through 7C are circuit diagrams showing the functioning of the circuit of FIG. 6 for various configurations of the first through fourth switching transistors 215, 220, 225, and 230. As with FIGS. 5A through 5C, since FIGS. 7A through 7C each address only specific settings of the switching transistors 215, 220, 225, and 230, they each replace the switching transistors 215, 220, 225, and 230 with their functional equivalents for that particular setting, i e. short circuits for "on" transistors, and open circuits for "off" transistors. In addition, to make the functioning circuits more clear, FIGS. 7A through 7C each omit the parts of the circuit that are short-circuited due to switching or differential transistors that are turned off.

FIG. 7A is similar to FIG. 5A and shows the situation where the control signals are set as follows: $S_1$ is "0", $S_2$ is "1", $S_3$ is "0", and $S_4$ is "1." As with the circuit if FIG. 5A, the first and fourth switching transistors 215 and 230 are "on" and the second and third switching transistors 220 and 225 are "off." The first differential transistor 105 is thus turned on and the second differential transistor 110 is turned off and quickly pulled down to prevent if from floating.

The regulated cascode current mirror resulting from this configuration is shown in FIG. 7A in more detail than the corresponding circuit in FIG. 5A. In particular, the resulting current mirror comprises the first differential transistor 105, the first and second mirror transistors 255 and 260, and the first and second amplifier transistors 320 and 325.

FIG. 7B is similar to FIG. 5B and shows the situation where the control signals are set as follows: $S_1$ is "1", $S_3$ is "0", $S_3$ is "1", and $S_4$ is "0." In this case, the first and fourth switching transistors 215 and 230 are "off" and the second and third switching transistors 220 and 225 are "on." The second differential transistor 110 is thus turned on and the first differential transistor 105 is turned off and quickly pulled down to prevent if from floating.

The regulated cascode current mirror resulting from this configuration is shown in FIG. 7B in more detail than the corresponding circuit in FIG. 5B. In particular, the resulting current mirror comprises the second differential transistor 110, the first and second mirror transistors 255 and 260, and the first and second amplifier transistors 320 and 325.

FIG. 7C is similar to FIG. 5C and shows the situation where the control signals are set as follows: $S_1$ is "0", $S_2$ is "0", $S_3$ is "0", and $S_4$ is "0." In this case, the first and second switching transistors 215 and 220 are on and the third and fourth switching transistors 225 and 230 are off. In this configuration the first and second differential transistors 105 and 110 are both turned on.

The regulated cascode current mirror resulting from this configuration is shown in FIG. 7C in more detail than the corresponding circuit in FIG. 5C. In particular, the resulting current mirror is a dual output current mirror comprising the first and second differential transistors 105 and 110, the first and second mirror transistors 255 and 260, and the first and second amplifier transistors 320 and 325.

Figure 8:
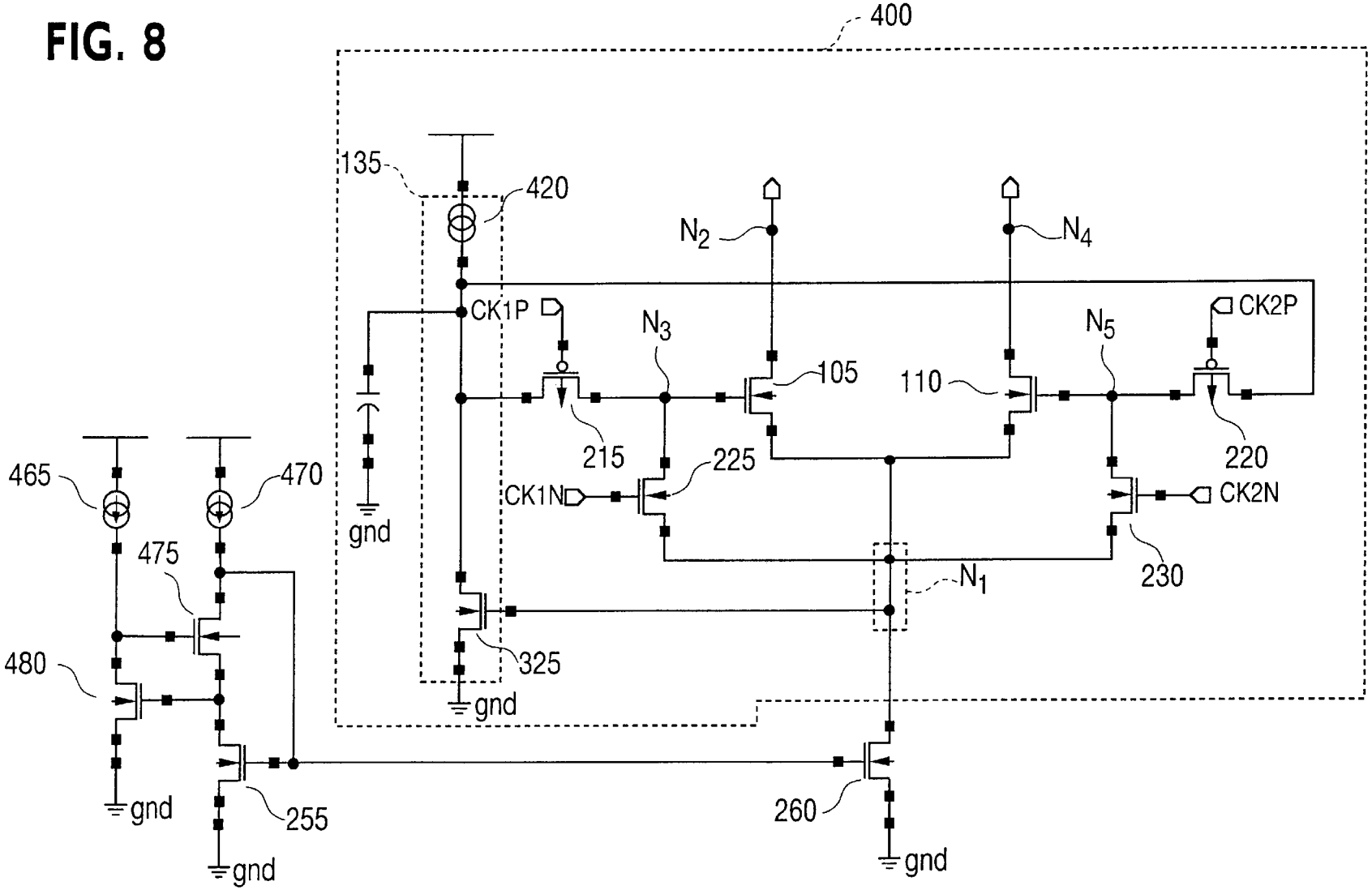
FIG. 8 is a circuit diagram showing a switched current source according to a fifth preferred embodiment of the present invention.

FIG. 8 shows a switched current source according to a fifth preferred embodiment of the present invention. The fifth embodiment is similar to the first through fourth preferred embodiments, except that it includes a different configuration for the voltage amplifier 135 in the differential current switch 400. The fifth embodiment also provides a slightly different circuit for providing the input current $I_{IN}$ to the input node $N_1$.

The voltage amplifier 135 in the fifth preferred embodiment includes the second amplifying transistor 325, but replaces the first amplifying resistor 320 with a third current source 420.

The input current $I_{IN}$ is supplied in the fifth embodiment by a current mirror circuit comprising first and second mirror transistors 255 and 260, fourth and fifth current sources 465 and 470, and first and second current supply transistors 475 and 480. The first mirror transistor 255 is connected between the first current supply transistor 475 and ground, and has its gate connected to the fifth current source 470. The second mirror transistor 260 is connected between the first node $N_1$ and ground, and has its gate connected to the gate of the first mirror transistor 255. The first current supply transistor 475 is connected between the fifth current supply 470 and the first mirror transistor 255, and has its gate connected to the fourth current supply 465. The second current supply transistor 480 is connected between the fourth current supply 465 and ground, and has its gate connected to the point where the first power supply transistor 475 and the first mirror transistor 255 are connected.

The size of the transistors in this circuit as well as the parameters of the current sources are chosen so as to meet the following equality:

$$V_{GS325}=V_{DS255} \tag{2}$$

where $V_{GS425}$ is the gate-source voltage of the second amplifying transistor 325, and $V_{DS255}$ is the drain-source voltage of the first mirror transistor 255.

The operation of the switched current source of the fifth preferred embodiment is similar to that of the first through fourth embodiments described above.

Figure 9:
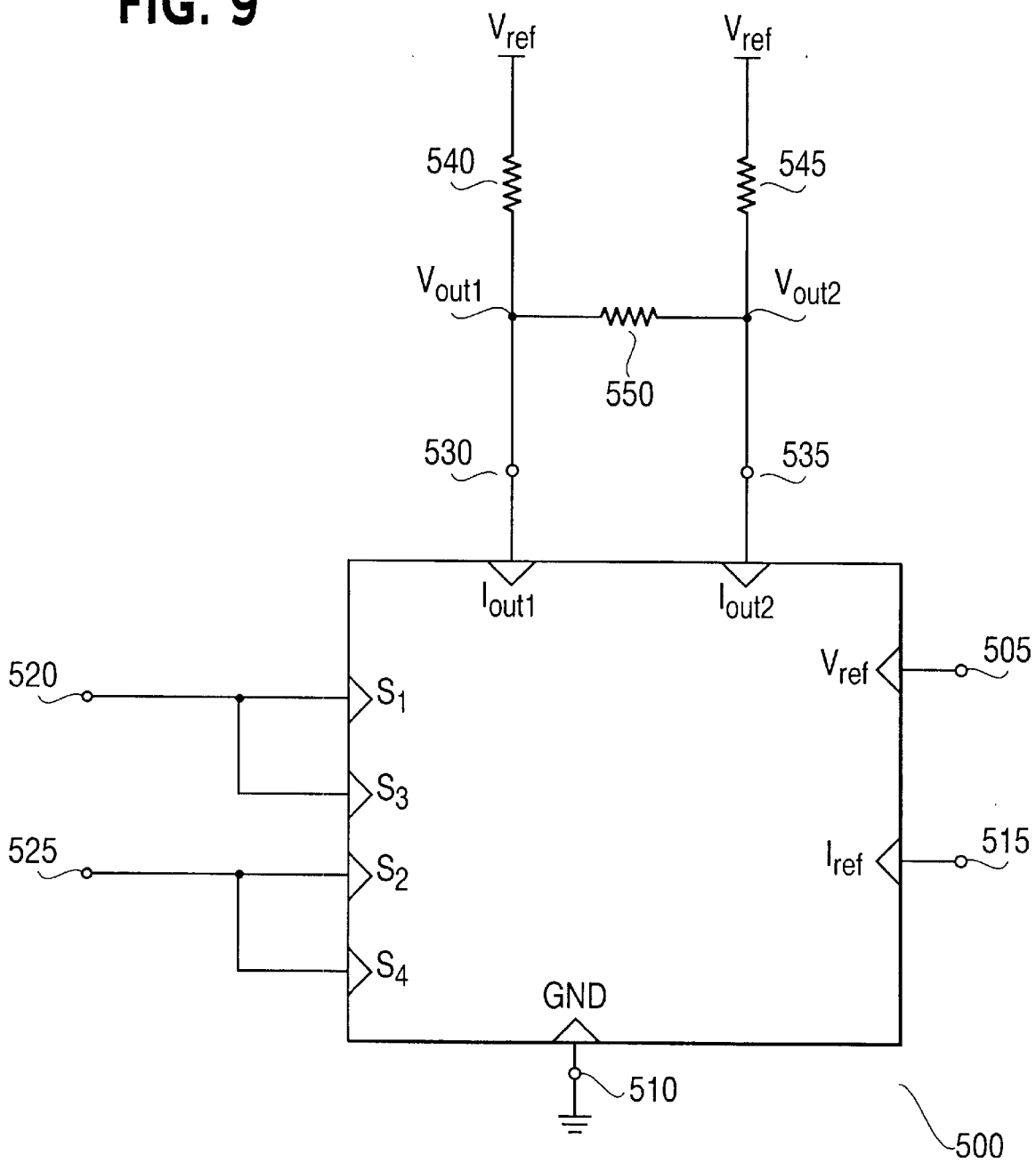
FIG. 9 shows the pin connections for a precision differentially switched current source according to the present invention, along with an output load attached to the output nodes.

FIG. 9 shows the pin connections for a differential current switch 500 according to the second through fifth preferred embodiments of the present invention. In addition, FIG. 9 shows the differential current switch connected to an output load.

As shown in FIG. 9, the differential current switch of the present invention is connected between a reference voltage $V_{ref}$ and ground at reference and ground pins 505 and 510, respectively. The differential current switch receives as input signals a reference current $I_{REF}$ (which is used to generate the input current $I_{IN}$) at the current input pin 515, a first signal that serves as the first and third control signals $S_1$ and $S_3$ at the first control pin 520, and a second signal that serves as the second and third two control signals $S_2$ and $S_4$ at the second control pin 525. The differential current switch provides as outputs first and second output currents $I_{OUT1}$ and $I_{OUT2}$ at the first and second output pins 530 and 535, respectively.

In this embodiment, the first and second output currents $I_{OUT1}$, and $I_{OUT2}$ are connected to an output load comprising first through third load resistors 540, 545, and 550. The first load resistor 540 is connected between the reference voltage $V_{ref}$ and the first Output pin 530. The second load resistor 545 is connected between the reference voltage $V_{ref}$ and the second output pin 535. The third load resistor 550 is connected between the first and second output pins 530 and 535. In alternate embodiments, the third load resistor 550 can be replaced by a transformer-resistor arrangement.

Figure 10:
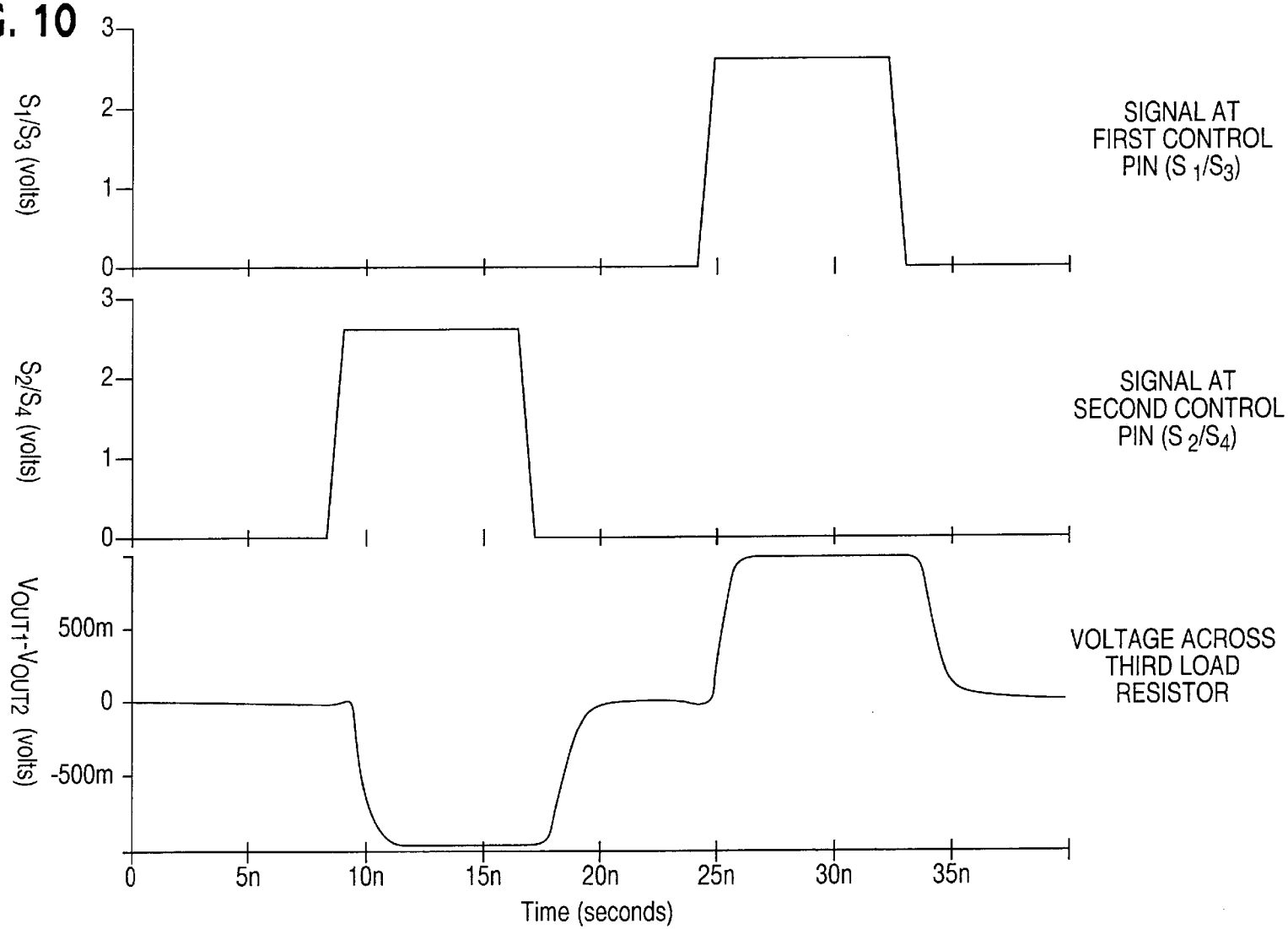
FIG. 10 is a timing diagram showing the voltage differential across the output load of the circuit of FIG. 8.

FIG. 10 is a timing diagram showing the voltage differential across the third load resistor 550 of the circuit of FIG. 9 for differing values of the control signals at the first and second control pins 520 and 525. In this timing diagram the control signal received at the first control pin 520 corresponds to the first and third control signals $S_1$ and $S_3$ of the third through fifth embodiments. The control signal received at the second control pin 525 corresponds to the second and fourth control signals $S_2$ and $S_4$ of the third through fifth embodiments.

For this timing diagram, the first and second load resistors 540 and 545 have a value of 50 ohms, and the third load resistor 550 has a value of 100 ohms. The reference voltage $V_{ref}$ is 2.7 V, and the current applied between the $I_{IN}$ is 40 mA.

As shown in FIG. 10, the voltage across the third load resistor 550 varies between three voltages −V, zero, and +V, depending upon the values of the control signals $S_1/S_3$ and $S_2/S_4$. When $S_1/S_3$ is high and $S_2/S_4$ is low, the voltage across the third load resistor 550 is −V. When $S_1/S_3$ and $S_2/S_4$ are both high, the voltage across the third load resistor 550 is zero. When $S_1/S_3$ is low and $S_2/S_4$ is high, the voltage across the third load resistor 550 is +V.

As shown in FIG. 10, (−V=−1.0V) and (+V=+1.0V). The data for FIG. 10 was obtained through the performance of a simulation of the operation of the circuit of FIG. 9.

Although all of the preferred embodiments are described above using CMOS transistors, this invention is equally applicable to other transistor technologies. For example, the current invention could be implemented using bipolar or BiCMOS technologies.

The present invention has been described by way of a specific exemplary embodiment, and the many features and advantages of the present invention are apparent from the written description. Thus, it is intended that the appended claims cover all such features and advantages of the invention. Further, since numerous modifications and changes will readily occur to those skilled in the art, it is not desired to limit the invention to the exact construction and operation ad illustrated and described. Hence, all suitable modifications and equivalents may be resorted to as falling within the scope of the invention.

What is claimed is:

1. A switched current source comprising:

a differential amplifier having a current input, a first control input connected to a first node, a second control input connected to a second node, and first and second current outputs;

a voltage amplifier, having a first amplifier input connected to a reference voltage, a second amplifier input connected to the current input, and an amplifier output connected to and amplifier output node;

a first switch connected between the amplifier output node and the first node, and being controlled by a first control input;

a second switch connected between the amplifier output node and the second node, and being controlled by a second control input;

a third switch connected between a reference node and the first node, and being controlled by a third control input; and a fourth switch connected between the reference node and the second node, and being controlled by a fourth control input.

2. A switched current source, as recited in claim 1, wherein the reference node is connected to the current input.

3. A switched current source, as recited in claim 1, wherein the reference node is connected to ground.

4. A switched current source, as recited in claim 1, further comprising a first current source for providing a first current to the current input.

5. A switched current source, as recited in claim 1, wherein the first current source further comprises:

a second current source; and a first current mirror connected to the second current source and operating to provide the first current to the current input.

6. A switched current source, as recited in claim 5, wherein the second current source comprises a second current mirror.

7. A switched current source, as recited in claim 1, further comprising a capacitor connected between the amplifier output node and ground.

8. A switched current source, as recited in claim 1, wherein the first and third control inputs are the same signal and the second and fourth control inputs are the same signal.

9. A switched current source, as recited in claim 1, wherein the third control input is the inverse of the first control input and the fourth control input is the inverse of the second control input.

10. A switched current source, as recited in claim 1, wherein the first through fourth switches are first through fourth switching transistors controlled by the first through fourth control inputs, respectively.

11. A switched current source, as recited in claim 10, wherein the first through fourth switching transistors are MOS transistors and the first through fourth control inputs are respectively provided to first through fourth gate electrodes of the first through fourth switching transistors, respectively.

12. A switched current source, as recited in claim 11, wherein the first and second switching transistors are PMOS transistors and the third and fourth switching transistors are NMOS transistors.

13. A switched current source, as recited in claim 12, wherein the first and third control inputs are the same signal and the second and fourth control inputs are the same signal.

14. A switched current source, as recited in claim 10, wherein the first through fourth switching transistors are bipolar transistors and the first through fourth control inputs are respectively provided to first through fourth base electrodes of the first through fourth bipolar switching transistors.

15. A switched current source, as recited in claim 1, wherein the differential amplifier comprises:

a first differential transistor having its gate connected to the first node, its source connected to the current input, and its drain connected to the first current output; and a second differential transistor having its gate connected to the second node, its source connected to the current input, and its drain connected to the second current output.

16. A switched current source, as recited in claim 15, wherein the first and second differential transistors are MOS transistors.

17. A switched current source, as recited in claim 1, wherein the voltage amplifier comprises:

a first voltage amplifying transistor connected between the reference voltage and the amplifier output node; and a second voltage amplifying transistor connected between the amplifier output node and ground, having its gate connected to the input node.

18. A switched current source, as recited in claim 17, wherein the first voltage amplifying transistor is a PMOS transistor and the and second voltage amplifying transistor is an NMOS transistor.

19. A switched current source, as recited in claim 1, wherein the voltage amplifier comprises:

a current source for supplying a current to the amplifier output node; and a voltage amplifying transistor connected between the amplifier output node and ground, having its gate connected to the input node.

20. A switched current source comprising:

a first differential transistor having its gate connected to a first intermediate node, its source connected to an input node, and its drain forming a first output node;

a second differential transistor having its gate connected to a second intermediate node, its source connected to the input node, and its drain forming a second output node;

a voltage amplifier, having a first amplifier input connected to a reference voltage, a second amplifier input connected to the input node, and an amplifier output connected to an amplifier output node, a first switching transistor connected between the amplifier output node and the first intermediate node, having its gate connected to a first control input;

a second switching transistor connected between the amplifier output node and the second intermediate node, having its gate connected to a second control input;

a third switching transistor connected between the input node and the first intermediate node, having its gate connected to a third control input; and a fourth switching transistor connected between the input node and the second intermediate node, having its gate connected to a fourth control input.

21. A switched current source as recited in claim 20, further comprising a first current source for providing a first current to the input node.

22. A switched current source as recited in claim 21, wherein the first current source comprises:

a second current source;

a first current-mirror transistor having its drain and gate connected to the second current source and its source connected to ground;

a second current-mirror transistor having its gate connected to the gate of the first current-mirror transistor, its source connected to ground, and its drain connected to the input node.

23. A switched current source as recited in claim 22, wherein the second current source comprises a second current mirror.

24. A switched current source as recited in claim 22, wherein the second current source comprises:

a third current source connected between a supply voltage and a first supply node;

a fourth current source connected between a supply voltage and a second supply node;

a first supply transistor connected between the first supply node and ground; and a second supply transistor connected between the second supply node and a third supply node, wherein the first current mirror transistor has its gate connected to the second supply node, and its drain connected to the third supply node.

25. A switched current source as recited in claim 20, wherein the third control input is the inverse of the first control input, and the fourth control input is the inverse of the second control input.

26. A switched current source as recited in claim 20, wherein the first and third control inputs are the same signal, and the second and fourth control inputs are the same signal.

27. A switched current source as recited in claim 20, wherein first through fourth switching transistors are MOS transistors.

28. A switched current source as recited in claim 27, wherein first and second switching transistors are PMOS transistors, and the third and fourth switching transistors are NMOS transistors.

29. A switched current source, as recited in claim 20, wherein the voltage amplifier comprises:

a first voltage amplifying transistor connected between the reference voltage and the amplifier output node; and a second voltage amplifying transistor connected between the amplifier output node and ground, having its gate connected to the input node.

30. A switched current source, as recited in claim 29, wherein the first voltage amplifying transistor is a PMOS transistor and the and second voltage amplifying transistor is an NMOS transistor.

31. A switched current source, as recited in claim 20, wherein the voltage amplifier comprises:

a current source for supplying a current to the amplifier output node; and a voltage amplifying transistor connected between the amplifier output node and ground, having its gate connected to the input node.

* * * * *